United States Patent [19]

O'Shields et al.

[11] Patent Number: 5,055,817

[45] Date of Patent: Oct. 8, 1991

[54] FUSE WITH IMPROVED FUSIBLE ELEMENT

[75] Inventors: Larry D. O'Shields, York Harbor, Me.; Richard J. Perreault, Amesbury, Mass.

[73] Assignee: Gould Inc., Eastlake, Ohio

[21] Appl. No.: 592,262

[22] Filed: Oct. 3, 1990

[51] Int. Cl.[5] ..... H01H 85/04

[52] U.S. Cl. ..... 337/161; 337/232; 337/295

[58] Field of Search ..... 337/295, 232, 231, 252, 337/290, 291, 293, 158, 159, 160, 161, 162; 29/623

[56] References Cited

U.S. PATENT DOCUMENTS 2,659,790 11/1953 Jurgensen ..... 337/232
2,682,587 6/1954 Burt et al. ..... 337/232
4,749,980 6/1988 Morrill .

FOREIGN PATENT DOCUMENTS 807347 1/1959 United Kingdom ..... 337/295

*Primary Examiner*—Harold Broome
*Attorney, Agent, or Firm*—Fish & Richardson

[57] ABSTRACT

A fuse including a fuse casing having an opening at an end thereof, a terminal at the end of the casing, and at least one elongated fusible element electrically connected at an end thereof to the terminal, the element being made of a sheet metal and having an elongated body portion that extends along a longitudinal axis that passes through the opening and a bent tab at the end thereof, the bent tab having a smaller cross sectional area at the bend than the body portion, the bent tab being soldered to a contact surface of the terminal that is transverse to the axis, the bent tab making an acute angle with the contact surface and with the axis. Also disclosed is a fusible element with a curved body portion.

17 Claims, 1 Drawing Sheet

FUSE WITH IMPROVED FUSIBLE ELEMENT

BACKGROUND OF THE INVENTION

The invention relates to fuses in which ends of fusible elements are soldered to a surface of a terminal at an end of a fuse casing.

Some electrical fuses employ fusible elements made of sheet metal pieces that are soldered between facing surfaces of metal terminals at opposite ends of a fuse casing. The fuses typically are filled with arc-quenching fill material. The fusible elements typically have a plurality of notch sections at positions spaced along the lengths of the fusible elements. Notch sections are employed in order to have portions of reduced cross sectional area at which the fusible elements will initially fuse in the desired manner. Some notch sections have two outwardly directed recesses along two edges of the element and one or more holes cut out between the outwardly directed recesses. A fusible element may also employ a tin bead that is placed adjacent to a notch section and facilitates melting of the element at the notch section under low-current overload conditions. In order to provide larger current carrying capacity in a fuse, additional fusible elements can be connected in parallel between the terminals.

SUMMARY OF THE INVENTION

In one aspect, our invention features in general a fuse having a fusible element that is electrically connected at an end thereof to a terminal, the fusible element being made of sheet metal and having an elongated body portion and a bent tab at one end thereof. The bent tab has a smaller cross sectional area at the bend than the body portion and is soldered to a contact surface of the terminal. The bent tab makes an acute angle with the contact surface and with a longitudinal axis of the body portion. The bent tab is hinge-like, bending at its root section to the extent necessary to take up the variable space between terminals owing to tolerances in manufacture. This avoids putting longitudinal stress on the fusible element (e.g., avoiding bending at notch sections of the element).

In another aspect, our invention features in general a fuse having a fusible element electrically connected at an end thereof to a terminal, the fusible element being made of a sheet metal and having an elongated body portion with a curved cross section such that the body portion has concave and convex surfaces. The curved shape provides strength to the fusible element and additionally controls fulgurite generation, permitting closer spacing of fusible elements for a given cross-sectional, current-carrying area.

In preferred embodiments, the width of the bent tab is between 20%–40% of the width of the body portion, and the tab makes a less than a 45° angle (preferably less than a 30° angle) with the contact surface of the terminal. The fusible element has notch sections at which two segments connect adjacent element portions. The curved section is such that tangents to the ends of the curved section make an angle with each other of between 0° and 150° (preferably between 15° and 45°, and most preferably about 30° ). There are a plurality of fusible elements in the fuse casing, and the majority of the elements have their concave surfaces facing outward. The elements have between 1/32" and 5/32" radii of curvature (preferably between 1/16" and ⅛", most preferably about 3/32").

In another aspect, the invention features a method of making a fuse. A fuse casing is provided with a fusible element therein surrounded by arc-quenching fill material, the fusible element having a bent tab extending above the arc-quenching fill material. The bent tab has a smaller cross sectional area at the bend than that of an elongated body portion of the fusible element, and the bent tab makes an acute angle with the body portion. Solder is added to the tab; the solder and tab are contacted by a terminal as it is moved down on and secured to the fuse casing. The solder is heated in order to cause soldering of the bent tab to the contact surface.

In preferred embodiments, before adding the arc-quenching fill material and doing the soldering at the bent tab, a fixture is used to position the other end of the fusible element during soldering of the other end to a second terminal.

Other advantages and features of the invention will be apparent to those skilled in the art from the following description of preferred embodiments thereof and from the claims.

DESCRIPTION OF PREFERRED EMBODIMENTS

The preferred embodiments will now be described.

DRAWINGS

STRUCTURE

Figure 1:
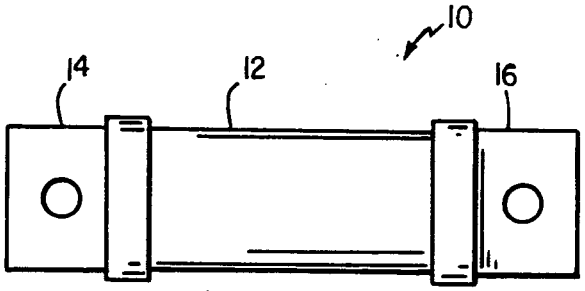
FIG. 1 is an elevation of a fuse according to the invention.
Figure 2:
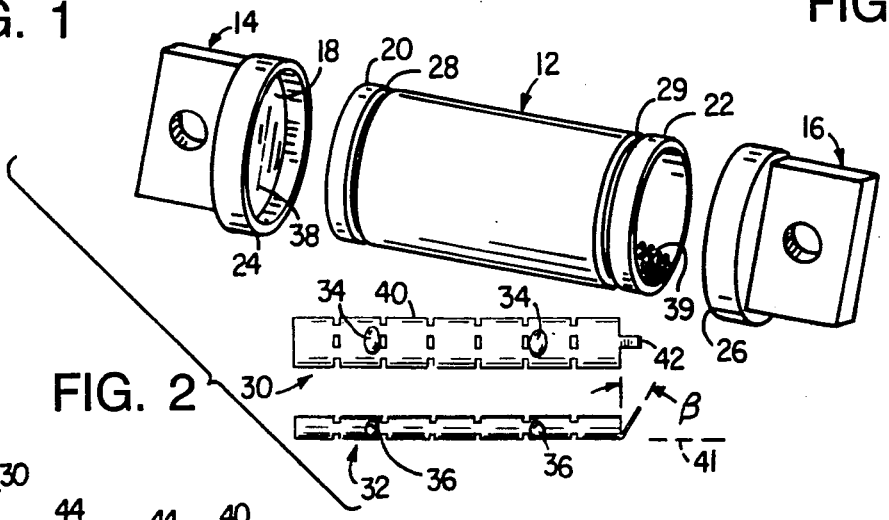
FIG. 2 is an exploded perspective view of the FIG. 1 fuse.

Referring to FIG. 1 there is shown fuse 10 having fuse casing 12 and copper end cap terminals 14, 16. Fuse casing 12 is made of melamine glass. Referring to FIG. 2, it is seen that end cap terminals 14, 16 have cup-shaped recesses 18 for receiving ends 20, 22 of fuse casing 12. In manufacture, the rims 24, 26 of end terminals 14, 16 are pressed into recesses 28, 29 of fuse casing 12. Fusible elements 30, 32, which have tin beads 34, 36 on them, are shown in orientations rotated 90° from each other in FIG. 2. Fusible elements 30, 32 are electrically connected between facing contact surfaces 38 (in FIG. 2 only the surface 38 of terminal 14 is shown) of terminals 14, 16 by soldering to contact surfaces 38. The interior of casing 12 is provided with arc-quenching fill material 39 (quartz sand) surrounding the fusible elements and substantially filling all voids.

Figure 9:
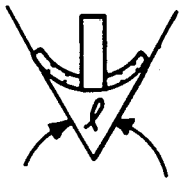
FIG. 9 is a sectional view of a fusible element of the FIG. 1 fuse.
Figure 3:
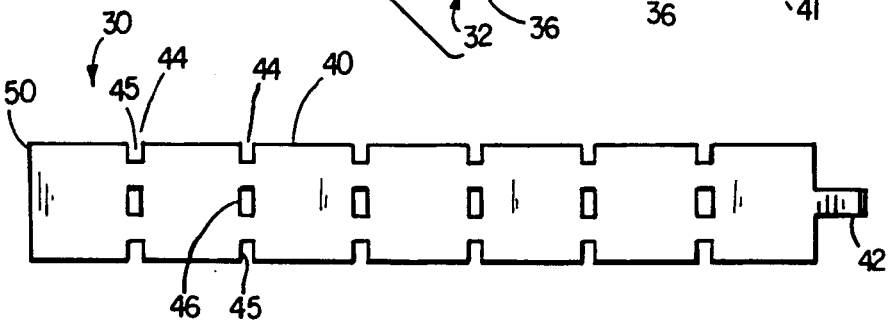
FIG. 3 is a plan view of a fusible element of the FIG. 1 fuse during manufacture prior to forming thereof.

Fusible elements 30, 32 each have an elongated body portion 40 that extends along longitudinal body axis 41 and a bent tab 42 at an end thereof. FIG. 3 shows a fusible element 30 prior to forming to provide the curved shape of body portion 40 and the bend for tab 42. Fusible element 30 is 1.512" long and 0.216" wide. Six notch sections 44 are provided equally spaced along fusible element 40 at 0.20" spacing, centerline to centerline. Notch sections 44 are 0.027±0.001" wide and include two outwardly facing recesses 45 (0.443" long) and elongated opening 46 (0.0903" long). Tab 42 is 1/16" wide. The width of the tab preferably is between 20% and 40% of the width of the body portion. The tab should have a larger cross-sectional area than the area at notch sections 44 (to avoid fusing at tabs 42 as opposed to notch sections 44) but should have less cross-sectional area than the body portion and should not be so wide as to increase the tab's strength and limit its ability to freely bend. The element is made of pure silver and is 0.00525" thick for a 100 amp fuse. The piece of sheet metal shown in FIG. 3 is curved about a longitudinal axis to provide a semicircular cross-section having a 3/32" radius there being an angle $\alpha$ (FIG. 9) of 30° between tangents to the ends of the curved section of the body portion. Tab 42 is bent to provide an initial 30° $\beta$ (FIG. 2) prior to assembly.

Figure 5:
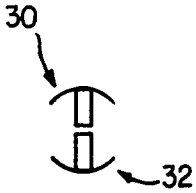
FIG. 5 is a plan view showing the arrangement of fusible elements in the FIG. 1 fuse.
Figure 6:
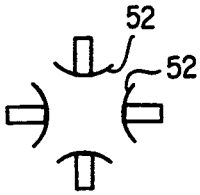
FIGS. 6–7 are plan views showing alternative arrangements of fusible elements.
Figure 8:
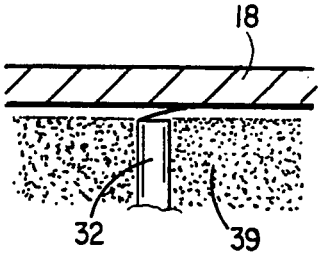
FIG. 8 is a partial vertical sectional view showing contact of a bent tab with a terminal contact surface after assembly of the terminal on the FIG. 4 subassembly.
Figure 7:
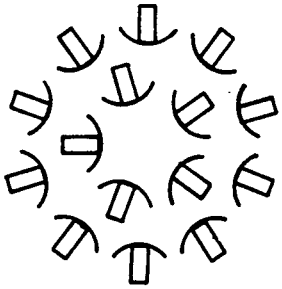

The number of fusible elements employed in a fuse depends upon the desired current-carrying capacity, and the arrangement of fusible elements in the fuse casing depends on the number of elements employed and the size of the fuse casing. FIG. 5 shows an arrangement for a fuse having two fusible elements 30, 32. The fusible elements are spaced such that the origins for their radii of curvature are located equally spaced on a bolt circle (bc) having a 0.069" diameter. Although it is generally desirable to have the concave faces of the elements facing outward, it is necessary that a minimum spacing between elements of 0.095" be maintained, and, given the 0.438" inner diameter of fuse casing 12, the two elements must face inward to maintain the spacing between them. More than two fusible elements can be provided, and they can be made of different thickness material in order to provide different current-carrying capacity. E.g., in FIG. 6, four fusible elements 52 are shown equally spaced on a 0.429" bc to provide 200 amp capacity, the fusible elements being made of 0.00625" thick sheet metal. The FIG. 6 arrangement is used in a fuse casing having a 0.687" inner diameter. FIG. 7 shows the fusible element arrangement for a 400 amp capacity fuse employing five fusible elements equally spaced on a 0.45" bc and ten fusible elements equally spaced on a 0.825" bc, the fusible elements being made of 0.00325" thick sheet metal. The fuse casing 12 used for the FIG. 7 arrangement has a 1.000" inner diameter.

In manufacture, solder paste is applied through a template to surface 38 of terminal 14 at the locations of the arcuate portions for fusible elements 30, 32, and terminal 14 is pressed onto end 20 of fuse casing 12 and crimped so that its rim 24 fits into recess 28. Fusible elements 30, 32 are properly positioned at the locations shown in FIG. 5 (corresponding to the locations of solder paste pads applied to surface 38) using a wooden fixture with holes that are shaped to engage the curved cross sections at the desired orientations, and the ends 50 of fusible elements 30, 32 are soldered to surface 38 via heating of the solder.

Figure 4:
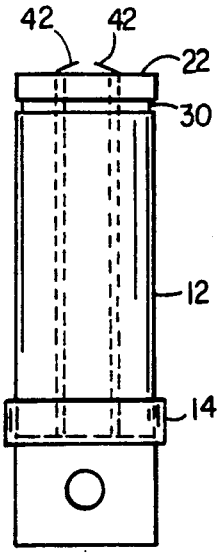
FIG. 4 is an elevation of a subassembly of the FIG. 1 fuse during manufacture thereof.

The wooden fixture is removed, and arc-quenching fill material (quartz sand) is poured into casing 12 to the upper surface of end 22, leaving bent tabs 42 extending above the arc-quenching material, as is shown in FIG. 4. Solder paste is then applied to the upper surfaces of bent tabs 42. Terminal 16 is moved downward to and pressed onto end 22, and rim 26 is crimped into recess 30. Bent tabs 42 contact surface 38 of terminal 16 and bend further as terminal 16 is pressed. The bodies 40 of fusible elements 30, 32 are not bent or crushed at their notch sections 44 thereof, because tabs 42 are hinge-like and bend at their roots more freely than the notch sections, the curved cross section and the spacing of two segments of the notch sections providing strength to the notch sections. The amount of bending of tabs 42 depends upon the actual sizes of the parts within their tolerance ranges. The fuse casings, end cap terminals, and elements are sized such that, if an element has a body length at the high end of its tolerance range, and, if the distance between facing surfaces 38 is at the low end of the range permitted by tolerances for the end cap terminals and the fuse casings, tabs 42 will make close to a 90° angle but are prevented from ever reaching 90° or permitting the interior surface 38 itself from pushing against bodies 40. If the tolerances are all at the other ends of their respective ranges, it is still guaranteed that the upper end of bent tab 42 will contact surface 38.

An induction heater is then used to cause melting of the solder masses at tabs 42. The tabs act as wicks for the solder, tending to cause a solder connection between surface 38 and the widths of bodies 40. The particles of the arc quenching fill material are prevented from getting between the tabs and the inner contact surfaces 38 of terminal 16 during manufacture, because tabs 42 stick above the upper surface of the fill material when the terminal is pressed on. An advantage of applying solder to the bent tabs is that a small amount of solder can be used, reducing the flux residue within the quartz fill after soldering.

In use, fusible elements 30, 32 fuse at notch sections 44 thereof under overload conditions. At high overload conditions, the entire elements are vaporized. At low overload conditions, the elements vaporize in the regions of the tin beads. The arch-quenching material helps retain the pressure and propagate the shock waves to fuse casing 12 and back again. During overload of electrical fuses, arc-quenching fill material often forms fulgurites, which are fused quartz masses with molecules of the vaporized elements therein. With the arrangement of FIG. 2, the concave surfaces face each other, owing to the constraints on minimum spacing between elements and the dimensions of the fuse casing. With the arrangements of FIGS. 6 and 7, the concave surfaces all face outwardly. This results in better performance because the heat tends to be directed outward toward the fuse casing, and the fulgurites are spread out more. If fulgurites from more than one element merge, there may be sufficient metal content to cause a conductive path from one terminal to the other. By spacing the fulgurites more, there is less tendency for the fulgurites to merge together and provide electrically conductive paths. In the FIG. 7 embodiment, there are two groups of elements at different radial locations. There are twice as many elements in the outer group, owing to the increased space, and the elements are angularly staggered from elements in the other group so as to promote spacing. The curved shape of the fusible elements causes the fulgurites to predominantly form in front of the concave portions out to about 3/32" in front of the element (there still is a disperse, narrow fulgurite formation out to about 1/32" on the convex side of the element) and permits providing a larger number of fusible elements in a fuse casing at closer spacing without increasing the risk of merging of fulgurites.

OTHER EMBODIMENTS

Other embodiments of the invention are within the scope of the following claims. E.g., other arrangements of elements could be used, and other materials (e.g., copper of bronze) could be used for the fusible elements. Also, solder can be applied in the vicinity of the bent tabs and can be applied in the form of a solder preform, e.g., a ring provided on the tab.

What is claimed is:

1. A fuse comprising a fuse casing having a chamber therein and an opening to said chamber, a terminal at said opening, and a plurality of elongated fusible elements that are located within said chamber, each said element being electrically connected at an end thereof to said terminal, each said element being made of sheet metal and having an elongated straight body portion that extends along a longitudinal axis that passes through said opening and is parallel to axes of other said elements, each said element having a bent tab at said end thereof, said bent tab having a smaller cross sectional area at the bend than said body portion, said bent tab being soldered to a contact surface of a said terminal that is transverse to said axis, said bent tab making an acute angle with said contact surface and with said axis.

2. A fuse comprising a fuse casing having a chamber therein and an opening to said chamber, a terminal at said opening, and a plurality of elongated fusible elements that are within said chamber, each said element being electrically connected at an end thereof to said terminal, each said element being made of a sheet metal and having an elongated straight body portion that extends along a longitudinal axis that passes through said opening and is parallel to axes of other said elements, each said element having a curved cross section in a plane transverse to said axis such that said body portion has concave and convex surfaces, said end of said fusible element being soldered to a contact surface of a said terminal that is transverse to said axis.

3. A fuse comprising a fuse casing having a chamber therein and an opening to said chamber, a terminal at said opening, and at least one elongated fusible element that is within said chamber and is electrically connected at an end thereof to said terminal, said element being made of a sheet metal and having an elongated body portion that extends along a longitudinal axis that passes through said opening and has a curved cross section in a plane transverse to said axis such that said body portion has concave and convex surfaces, said end of said fusible element being soldered to a contact surface of a said terminal that is transverse to said axis, wherein said element has a bent tab at an end thereof, said bent tab having a smaller cross sectional area at the bend than said body portion, said bent tab being soldered to a contact surface of said terminal that is transverse to said axis, said bent tab making an acute angle with said contact surface and said axis.

4. The fuse of claim 1 or 3 wherein said bent tab has a width that is 20%–40% the width of said body portion.

5. The fuse of claim 2 or 3 wherein tangents to the ends of said curved cross section of said body portion in said plane make an angle between 0° and 150°.

6. The fuse of claim 2 or 3 wherein tangents to the ends of said curved cross section of said body portion in said plane make an angle between 15° and 45°.

7. The fuse of claim 2 wherein said body portion has a notch section at which there is less material than adjacent portions of said body portion, said notch section having two connecting segments that connect said adjacent portions and are spaced from each other and are spaced inward from the sides of the body portion.

8. The fuse of claim 3 wherein said body portion has a notch section at which there is less material than adjacent portions of said body portion, said notch section having two connecting segments that connect said adjacent portions and are spaced from each other and are spaced inward from the sides of the body portion, said bent tab having a larger cross sectional area than the combined cross sectional area of said segments.

9. A fuse comprising a fuse casing having a chamber therein and an opening to said chamber, a terminal at said opening, and at least one elongated fusible element that is within said chamber and is electrically connected at an end thereof to said terminal, said element being made of a sheet metal and having an elongated body portion that extends along a longitudinal axis that passes through said opening and has a curved cross section in a plane transverse to said axis such that said body portion has concave and convex surfaces, said end of said fusible element being soldered to a contact surface of a said terminal that is transverse to said axis, wherein there are a plurality of said elongated fusible elements located within said casing with their longitudinal axes parallel to each other, and wherein the majority of said elements have their concave surfaces directed outward.

10. The fuse of claim 9 wherein said fuse casing is cylindrical, and said fusible elements are arranged in groups, one group being positioned more radially outward from the axis of said fuse casing than the other group, elements in one group being angularly staggered from the closest elements in the other group.

11. The fuse of claim 10 wherein said one group has twice as many elements as said other group.

12. The fuse of claim 2 wherein said elements have between 1/32" and 5/32" radii of curvature.

13. The fuse of claim 12 wherein said elements have between 1/16" and ⅛" radii of curvature.

14. The method of making a fuse comprising providing an assembly comprising a fuse casing having an upwardly directed opening, arc-quenching fill material in said fuse casing and a plurality of fusible elements in said fuse casing, each said element being made of a sheet metal and having an elongated straight body portion that extends along a longitudinal axis that passes through said opening and is parallel to axes of other said element, each said element having a bent tab having a smaller cross sectional area at the bend than said body portion, each said bent tab making an acute angle with said axis, each said bent tab extending above an upper surface of said arc-quenching fill material, moving a terminal having a contact surface downward toward said fuse casing so as to contact said bent tabs and cause said bent tabs to bend further, and securing said terminal to said casing, said bent tabs making an acute angle with said contact surface.

15. The method of claim 14 wherein solder is placed in the vicinity of said bent tab, and further comprising, after said moving, heating said solder to cause fusing thereof.

16. The method of claim 14 wherein solder is placed between said bent tab and a contacting portion of said contact surface and further comprising, after said moving, heating said solder to cause fusing thereof.

17. The method of claim 16 wherein said elongated body portion has an curved cross section in a plane transverse to said axis such that said body portion has concave and convex surfaces.

* * * * *